US005833329A

United States Patent [19]

Smith et al.

[11] Patent Number: 5,833,329

[45] Date of Patent: Nov. 10, 1998

[54] LIGHTWEIGHT RACK

[75] Inventors: David A. Smith; David J. Cousins; John M. Tagg; Phyllis S. Rabun, all of Huntsville, Ala.

[73] Assignee: McDonnell Douglas Corporation, Huntington Beach, Calif.

[21] Appl. No.: 726,327

[22] Filed: Oct. 3, 1996

[51] Int. Cl.[6] ..... E04H 1/12

[52] U.S. Cl. ..... 312/3; 312/6; 312/265.1; 135/134

[58] Field of Search ..... 211/182, 189; 135/900, 901, 902, 904, 909, 124, 128, 134, 148, 149; 312/3, 4, 5, 6, 257.1, 265.4

[56] References Cited

U.S. PATENT DOCUMENTS

| | | | |
|---|---|---|---|
| 630,685 | 8/1899 | Grace | 312/3 X |
| 1,394,007 | 10/1921 | Hall | 312/6 |
| 2,305,279 | 12/1942 | Smith | 312/3 |
| 2,517,757 | 8/1950 | Adlerstein | 312/3 |
| 3,760,943 | 9/1973 | Reader | 312/3 X |
| 3,999,727 | 12/1976 | Rennemann | 312/6 X |
| 4,270,816 | 6/1981 | Erickson et al. | 312/3 |
| 4,304,224 | 12/1981 | Fortney | 312/3 X |
| 4,316,644 | 2/1982 | Johnson | 312/6 X |
| 4,471,793 | 9/1984 | Cattaneo . | |
| 4,907,728 | 3/1990 | Giblet . | |
| 4,953,815 | 9/1990 | Beymer et al. . | |
| 5,105,954 | 4/1992 | Dahlquist . | |
| 5,163,569 | 11/1992 | Buff . | |
| 5,169,011 | 12/1992 | Ebeling et al. . | |
| 5,271,423 | 12/1993 | Eychaner | 135/134 |
| 5,335,684 | 8/1994 | Hanninen | 135/128 X |
| 5,366,124 | 11/1994 | Dearborn, IV . | |
| 5,448,867 | 9/1995 | Wilson . | |

FOREIGN PATENT DOCUMENTS

| | | | |
|---|---|---|---|
| 1076339 | 2/1960 | Germany | 135/134 |
| 884709 | 12/1961 | United Kingdom | 312/3 |

*Primary Examiner*—Peter M. Cuomo
*Assistant Examiner*—James O. Hansen
*Attorney, Agent, or Firm*—Harness Dickey & Pierce P.L.C.

[57] ABSTRACT

A lightweight rack structure is provided for use in a space station. The rack includes a deployable/folding rigid front frame including two side rails and upper and lower cross members connected to the two side rails. A flexible shell is connected to the front frame. The shell includes an upper wall portion, a lower wall portion, a pair of side wall portions and a rear wall portion. Support members are provided to support the flexible shell in a deployed position.

19 Claims, 4 Drawing Sheets

FIG 1
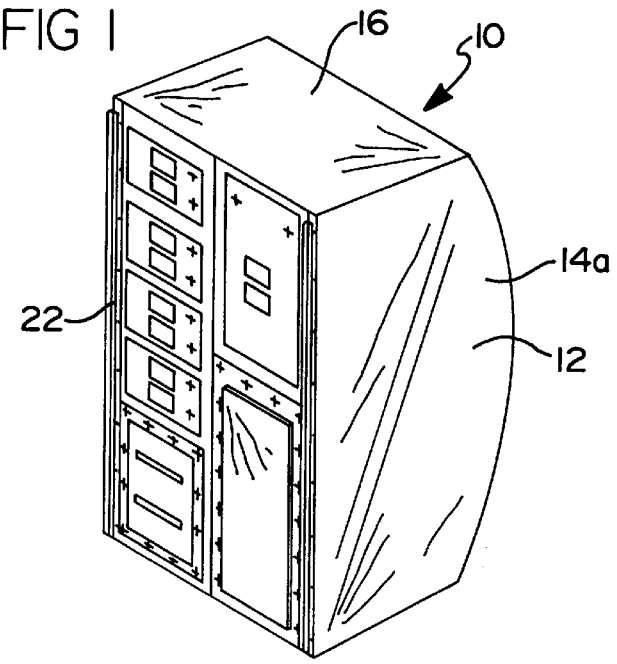
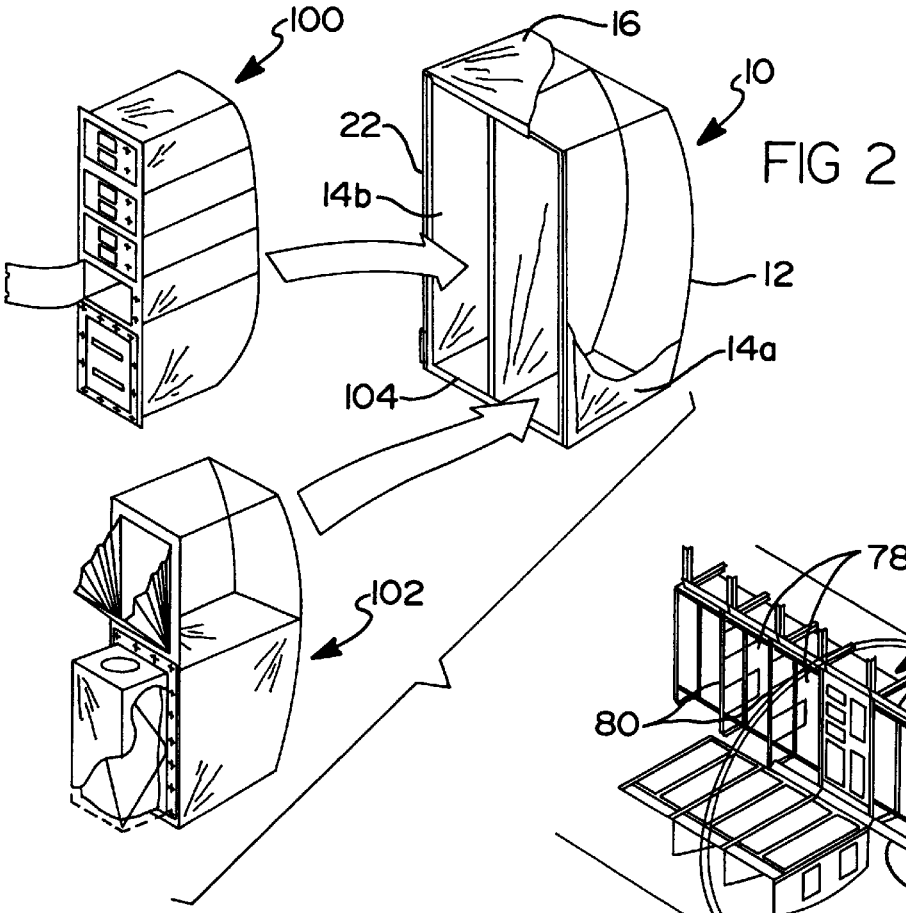
FIG 2
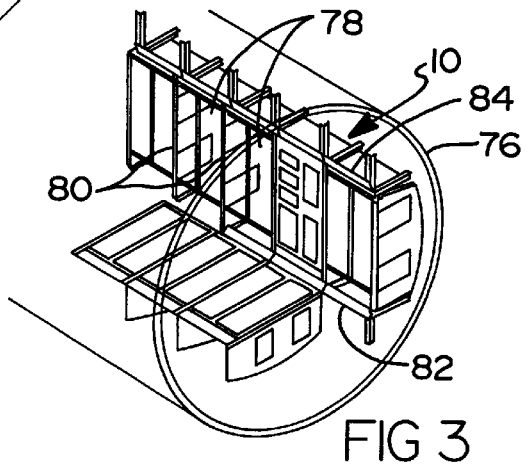
FIG 3

FIG 4
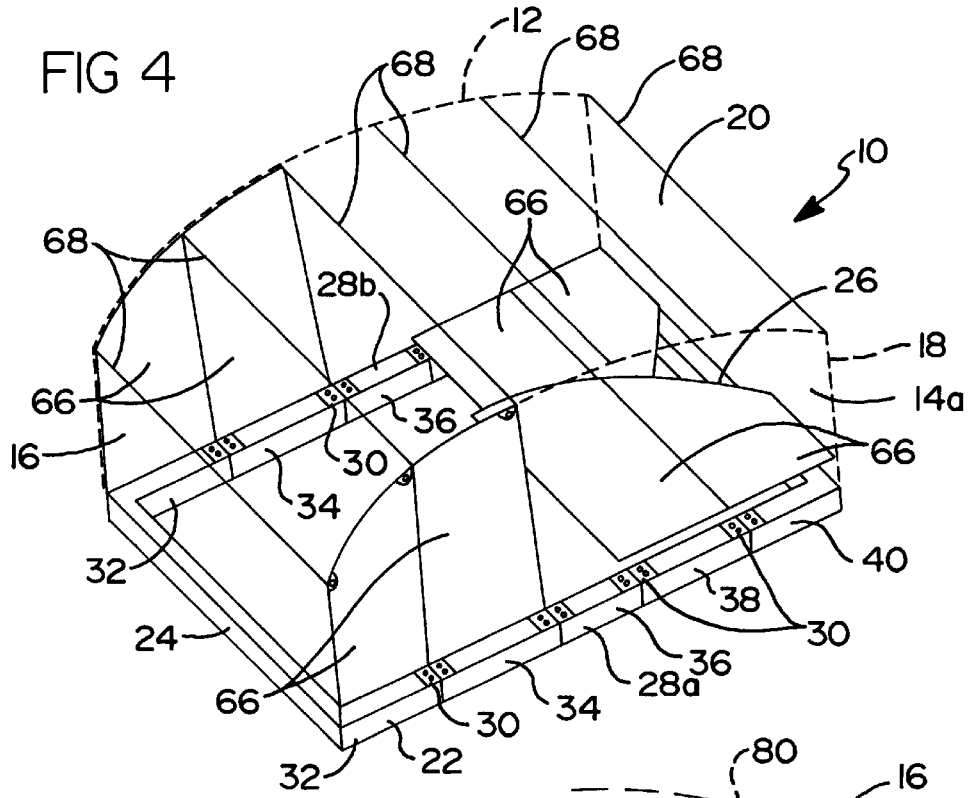
FIG 6
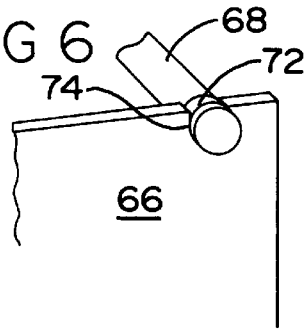
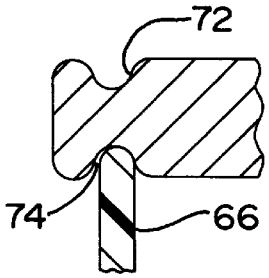
FIG 7
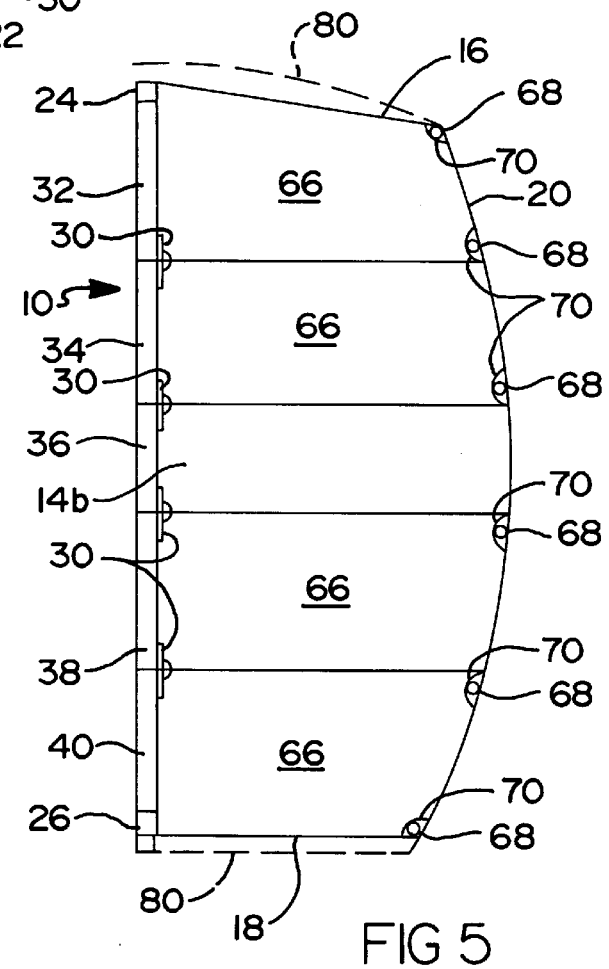
FIG 5

FIG 13
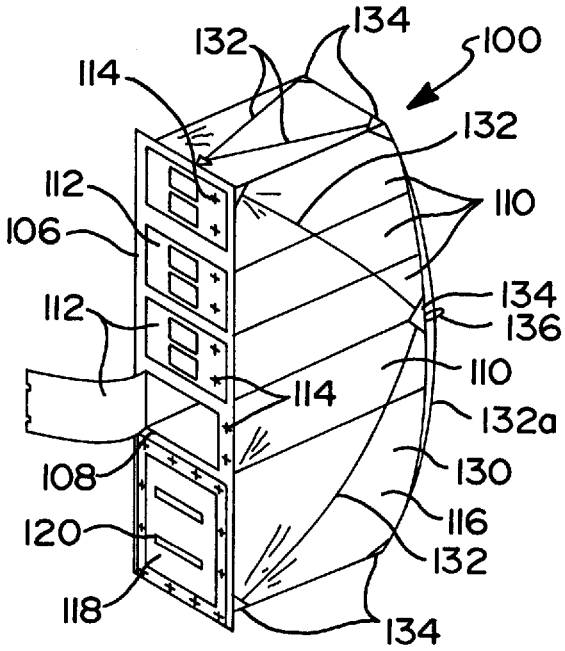
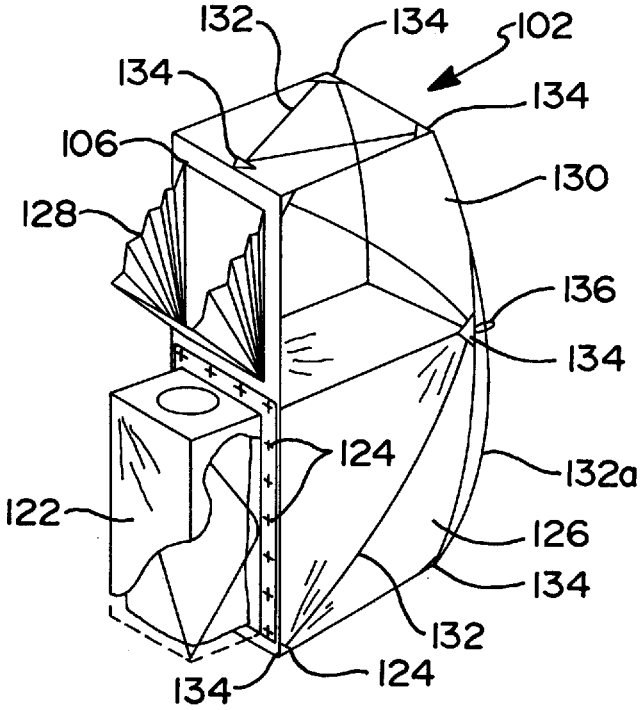
FIG 14

LIGHTWEIGHT RACK

BACKGROUND OF THE INVENTION

1. Field of the Invention

The present invention relates to a lightweight rack structure, and more particularly, to a lightweight rack structure designed for use as a payload rack aboard a space station.

2. Background and Summary of the Invention

The traditional racks currently in use by the space program require the use of ancillary secondary structure including metal drawers, trays, and containers to accommodate items within a rack, mid-deck locker, or other location. This approach, while meeting dynamic launch and landing requirements, uses a significant proportion of the available payload upmass and ensures that one-third to one-half of the volume allocated to the payload becomes unusable to the payload. Additionally, these traditional approaches do not optimize the transfer of contents within a space station or between space station and other space vehicles. The metal construction and unique restraint devices used do not lend themselves to safe or speedy transport through the one meter diameter tunnels which connect different space station modules.

Orbiter performance may limit the space station lab module to flying only four out of a capacity of twenty standard payload racks at launch. The other locations would be enclosed by rack volume closeouts (RVCOs). The primary purpose of these closeouts is to make the remainder of the U.S. lab module function as an efficient ventilation duct until additional payload racks can be brought up by the mini-pressurized logistics module (MPLM). Each RVCO weighs up to 27 pounds, provides little or no utility to the crew during experiment and logistic operations, and becomes dead weight once a replacement rack is delivered. In summary, roughly 80 percent of the lab volume is unusable at launch. With the pressing need to reduce the cost of payload to orbit and enhance the consumables transport capability between docked space vehicles, it has become apparent that an efficient and flexible human space logistics system will be required to support both the needs of the crew as well as science experimentation during future longer term operations.

Accordingly, the present invention provides a fabric based rack design which provides the on-orbit capacity of comparable hard racks currently in use at a lower implementation cost and with the approximate weight of an RVCO. Emphasis is placed on both the mass savings and volume optimization inherent in the rack design with comparisons to existing, more traditional stowage accommodations. Full deployment of the lightweight racks according to the present invention promises to significantly reduce the cost associated with human space logistics delivery by increasing pounds to orbit while reducing required crew intervehicular activity.

The rack structure according to the present invention provides a folding rigid front frame including two hinged side rails and upper and lower cross members connected to the side rails. A flexible shell is connected to the front frame. The flexible shell is provided with an upper wall portion, a lower wall portion, a pair of side wall portions and a rear wall portion. Support members are provided for supporting the flexible shell in a deployed position.

Further areas of applicability of the present invention will become apparent from the detailed description provided hereinafter. It should be understood however that the detailed description and specific examples, while indicating preferred embodiments of the invention, are intended for purposes of illustration only, since various changes and modifications within the spirit and scope of the invention will become apparent to those skilled in the art from this detailed description.

BRIEF DESCRIPTION OF THE DRAWINGS

The present invention will become more fully understood from the detailed description and the accompanying drawings, wherein:

FIG. 1 is a perspective view of a lightweight rack according to the principles of the present invention;

FIG. 2 is an exploded perspective view illustrating the removability of the compartmentalized stowage inserts for use with the lightweight rack of the present invention;

FIG. 3 illustrates a lightweight rack, according to the present invention, being deployed in a space station according to the principles of the present invention;

FIG. 4 is a perspective view illustrating the frame and support structure of the lightweight rack according to the principles of the present invention;

FIG. 5 is a cross-sectional view taken along line 5—5 of FIG. 4;

FIG. 6 is a detailed view of the engagement of the struts with the petal-like support members according to the principles of the present invention;

FIG. 7 is a cross-sectional view taken along line 7—7 of FIG. 6;

FIG. 13 is a perspective view of a compartmentalized stowage insert illustrating different features that can be utilized with the insert; and FIG. 14 is a perspective view of a second compartmentalized stowage insert illustrating additional features which can be utilized with the insert.

DETAILED DESCRIPTION OF THE PREFERRED EMBODIMENTS

Figure 8:
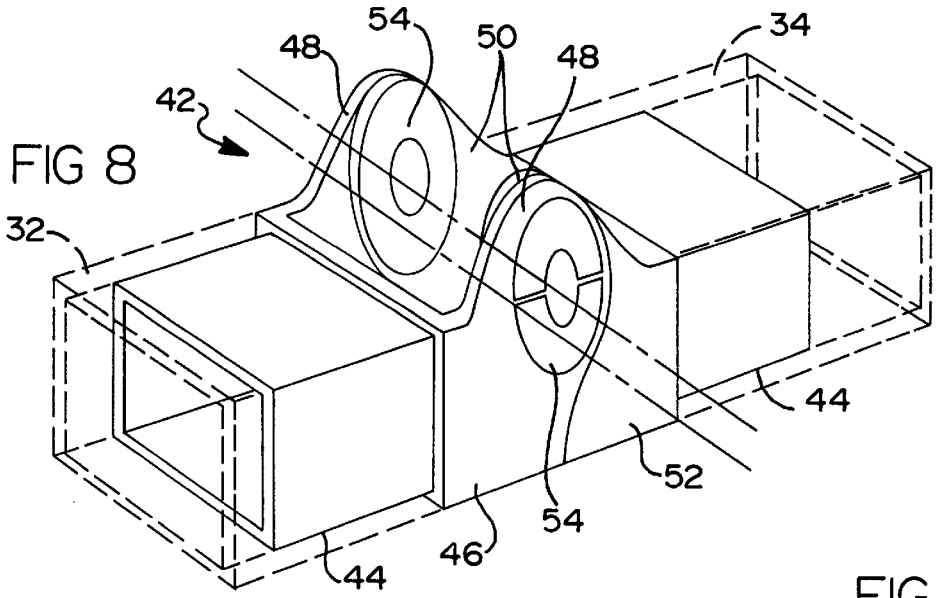
FIG. 8 is a perspective view of a hinge member for use with the present invention.

With reference to FIGS. 1–14, the lightweight rack 10 of the present invention will be described. The lightweight rack 10 includes a flexible shell 12 including a pair of side wall portions 14*a*, 14*b*, an upper wall portion 16, a lower wall portion 18, and a rear wall portion 20. Flexible shell 12 is connected to a rigid front frame 22. Front frame 22 includes an upper cross member 24, a lower cross member 26, and a pair of side members 28*a*, 28*b*.

According to a preferred embodiment of the present invention, side rail members 28*a*, 28*b* include a plurality of sections joined together by hinges 30. The side rail sections include an upper section 32 connected to upper cross member 24. A pair of upper intermediate sections 34 are hingedly attached to upper sections 32. A pair of middle sections 36 are hingedly attached to the upper intermediate sections 34. A pair of lower intermediate sections 38 are hingedly attached to middle sections 36. A pair of lower sections 40 are hingedly attached to lower intermediate sections 38. Lower cross member 26 is attached to lower sections 40.

Front frame 22 is preferably formed of tubular aluminum which is sized to withstand a 125 pound astronaut zero g kick-off load as well as other space station intervehicular activity loads. In other words, in the zero gravity environment within the space station, the walls of the space station are often used or "kicked-off" for propelling the occupants in a zero gravity environment. The flexible shell 12 is attached to the outer surface of front frame 22. Flexible shell 12 can be made from any flexible material including fabric. Preferably, flexible shell 12 is made from a high strength, non-flammable fabric.

Figure 9:
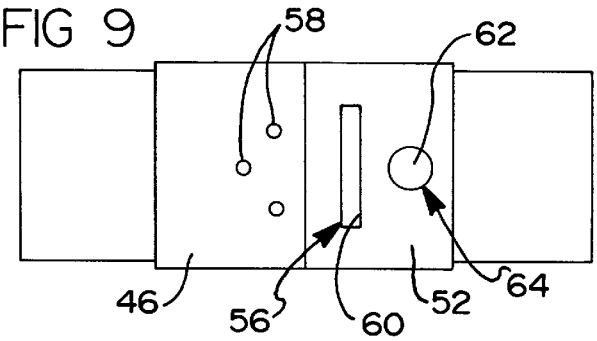
FIG. 9 is a front view of the hinge shown in FIG. 8.

The hinges 30 are capable of being releasably locked in an open position. FIGS. 8 and 9 illustrate a hinge design which can be used with the present invention. Hinge 42 is provided with hinge insert portions 44 which are received within side rail sections such as upper section 32 and intermediate section 34, for example. A first hinge portion 46 is provided with pivot arms 48 which are attached to corresponding pivot arms 50 of second hinge portion 52 by pivot members 54. With reference to FIG. 9, a locking structure is shown with a shear tongue 56 mounted to first hinge portion 46 by mounting screws 58. Shear tongue 56 is received in a tongue receiving portion 60 of second hinge portion 52. Shear tongue 56 is also provided with a release button 62 which is received in a release button portion 64, thus, the hinge 42 can be locked in a flat position and released by pressing release button 62 to disengage shear tongue 56 from tongue receiving portion 60 and allowing free relative motion of first hinge portion 46 relative to second hinge portion 52. It should be noted that hinges of this design are generally known in the art. The locking feature may be separated from the hinge itself with no change of function.

The fabric side wall portions 14*a*, 14*b* of the lightweight rack are deployed and kept in shape by fabric encased, semi-rigid foam petal-like support members 66. Support members 66 hinge to either the front frame 22 or flexible shell 12 along the front frame. The support members 66 are movable from a stored position as shown in the right half portion of FIG. 4, to a deployed position as shown in the left half portion of FIG. 4. Support members 66 provide the dual function of maintaining the profile of the lightweight rack 10 and protecting the contents and adjacent structures. A plurality of stiffening rods 68 are located in the rear wall portion 20 of flexible shell 12 and are sewn into the shell 12 by fabric sleeves 70, as shown in FIG. 5. Rods 68 also function as a detent for support members 66, as shown in FIGS. 6 and 7. Each end of rods 68 are provided with a groove 72 which mate with a slot 74 provided in an upper surface of a support member 66. The engagement of grooves 72 with slots 74 prevents inward movement of the deployed support members 66.

The lightweight rack 10 according to the present invention is designed to be deployed in a space station 76, as shown in FIG. 3, having a plurality of standard payload rack envelopes 78 which include side rails 80, a lower rail 82 and an upper rail 84.

Figure 10:
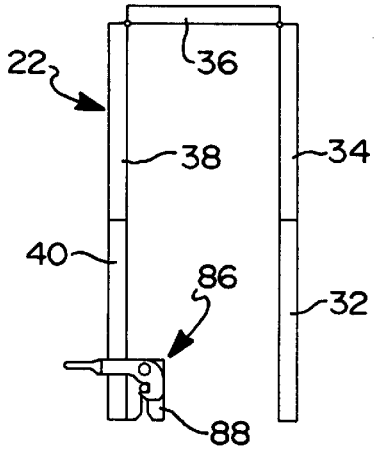
FIG. 10 shows a lower attachment bracket design which allows the lightweight rack to be attached to a standard space station payload rack standoff bracket.
Figure 12:
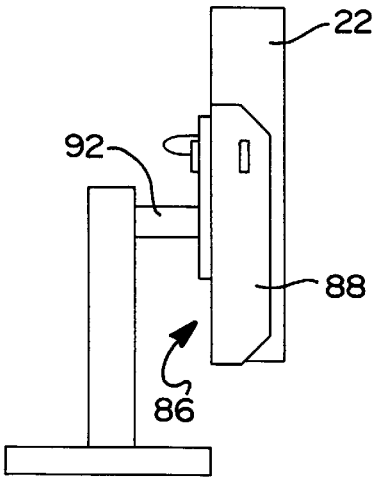
FIG. 12 is a front view of the attachment bracket shown in FIG. 11.
Figure 11:
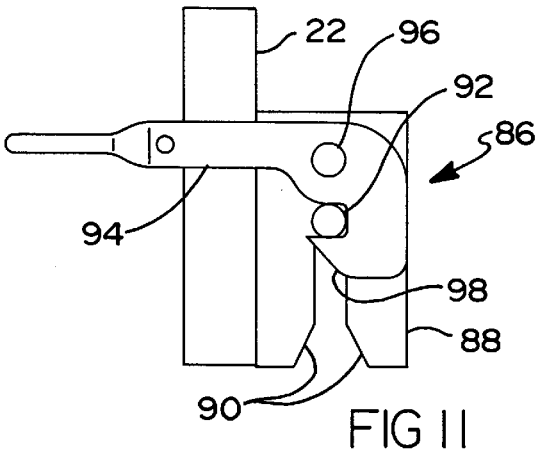
FIG. 11 a detailed side view of the attachment bracket design shown in FIG. 10.

In order to secure the lightweight rack 10 in the envelope 78 of the space station 76, an attachment bracket 86 is secured to a lower portion of front frame 22, as shown in FIG. 10. With reference to FIG. 11, a detailed view of attachment bracket 86 is shown. Attachment bracket 86 includes a stand-off bracket 88 having pair of capture ramps 90. Capture ramps 90 receive therebetween a standard bracket pin 92 which is an existing part of envelope 78. A catch 94 is pivotally attached to bracket 88 by pivot pin 96. Catch 94 is provided with a locking portion 98 which engages pin 92 for securing the front frame 22 of lightweight rack 10 in envelope 78. FIG. 10 illustrate a folded front frame 22 which can be attached to envelope 78 before the lightweight rack 10 is deployed.

With reference to FIG. 2, the lightweight rack 10 can be adapted to receive compartmentalized storage inserts 100, 102. Furthermore, a central partition 104 can be provided for subdividing lightweight rack 10. With reference to FIGS. 13 and 14, some of the features of the compartmentalized stowage inserts 100, 102 will be described. With reference to FIG. 13, compartmentalized stowage insert 100 is shown including a semi-rigid front panel 106 which can be fastened to front frame 22 of lightweight rack 10. Front frame 106 is provided with a plurality of openings 108 which allow access to various compartments 110. Each opening 108 is provided with a solid or a flexible door 112 which is held shut with quarter-turn fasteners 114 or by other means. A lower compartment 116 is provided with an access panel 118 provided with access slits 120.

With reference to FIG. 14, a deployable trash liner holder 122 is shown attached to the front frame 106 by a plurality of quarter turn fasteners 124. Behind the deployable trash liner holder 122 is a compartment 126 which is provided for trash storage. The upper portion of insert 102 is provided with general purpose stowage with spring closure 128. Inserts 100, 102 are each provided with a fabric shell 130 which is supported by a plurality of struts 132. The ends of struts 132 are inserted in pockets 134 which are sewn to the flexible shell 130 and are provided for securing the flexible shell 130 in the deployed position. In the stored position, the compartmentalized stowage inserts 100, 102 are designed to be folded and stored in sleeve-like pockets or suitcase type containers. The struts 132 are designed to be broken down into smaller sections. The rear struts 132*a* are attached to the flexible shell 130 by a fabric loop 136 which is designed to provide additional structural support to the flexible shell 130.

The lightweight rack 10 according to the principles of the present invention has several different uses. In particular, the lightweight rack 10 replaces low utility space station rack volume closeouts (RVCOs) at empty standard payload envelope locations providing immediately usable stowage volume while maintaining the air flow control of the RVCOs.

The lightweight rack according to the present invention supports quick, safe deployment in a zero gravity environment. Furthermore, the rack supports simplified transport through space station hatches. The flexible design allows movement through tight corners. The lightweight rack accommodates hard, soft, or oversized items and supports easy removal and replacement of the front face. This lightweight rack features modular organizer inserts which can be customized for various different uses. The rack deploys using fabric encased foam petals and soft detents and transforms easily to multiple configurations. In particular, the racks can be used as a crew habitat, flight stowage, accommodation for mid-deck lockers, and space station stowage trays, mid-deck locker volume equivalent stowage, trash bag stowage, loose items stowage, hard stowage containers, and powered electronic item accommodation. The rack can also perform as space furniture such as a sleep station, work desk/bench, personal closet, and photographic dark room.

The replacement of existing standard payload racks which are made from composite materials with the lightweight rack of the present invention results in a reduction of weight from approximately 400 to 50 pounds during launch/landing transport. This reduction in weight is significant in view of the fact that there is an estimated cost to orbit these items of approximately $10,000 per pound. The present invention can replace current rack volume closeouts at approximately equal weight substitution and provide immediate utility in comparison with the rack volume closeouts which have essentially no utility other than making the lab module function as an efficient ventilation duct. The lightweight rack of the present invention performs both the rack volume closeout function, but also provides additional utility as discussed above. Because the front face organizer elements are separate from the shell, the function of the lightweight rack at a specific location can be easily changed over time. Moreover, when no longer needed at one location, it can be set up as a stand-alone organizer, reinstalled at a different location, or stowed and returned to earth.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A rack, comprising:

a rigid front frame including two side rails and upper and lower cross members connected to said two side rails, said front frame defining an opening;

a flexible shell connected to said front frame, said shell having an upper wall portion, a lower wall portion, a pair of side wall portions and a rear wall portion;

support members for supporting said flexible shell in a deployed position; and a compartmentalized stowage insert housed by said flexible shell and having a front panel disposed in said opening in said front frame, said front panel having a plurality of doors attached thereto.

2. The rack according to claim 1, wherein said two side rails are foldable and include at least two sections.

3. The rack according to claim 2, wherein said at least two sections are hingedly attached to one another.

4. The rack according to claim 1, wherein said support members include a plurality of rods extending along said rear wall portion of said flexible shell.

5. The rack according to claim 1, wherein said front panel of said compartmentalized stowage insert includes a semi-rigid frame structure.

6. The rack according to claim 1, wherein said compartmentalized stowage insert includes at least one horizontal subdividing shelf.

7. The rack according to claim 1, wherein said compartmentalized stowage insert includes a flexible shell having a pair of side walls, an upper wall, a lower wall and a rear wall.

8. A rack, comprising:

a rigid front frame including two side rails, an upper cross member connected between upper ends of said two side rails and a lower cross member connected between lower ends of said two side rails, said front frame defining an opening;

a flexible shell connected to said front frame, said shell having an upper wall portion connected to said upper cross member, a lower wall portion connected to said lower cross member, a pair of side wall portions connected to each of said two side rails and a rear wall portion connected to said upper wall portion said lower wall portion and said pair of sidewall portions; and a plurality of semi-rigid petal-like support panels hingedly attached along each of said two side rails of said front frame to one of said flexible shell and said front frame and being pivotable relative to said side rails between a first stored position and a second deployed position for supporting said pair of sidewall portions of said flexible shell in a deployed position.

9. The rack according to claim 8, wherein said semi-rigid petal-like support panels are attached to said flexible shell at one end thereof.

10. The rack according to claim 8, further including a plurality of rods extending along said rear wall portion of said flexible shell.

11. The rack according to claim 10, wherein at least one of said rods includes a groove on each end thereof for mating with a corresponding edge on opposing petal-like support panels for holding said petal-like support panels in a deployed position.

12. The rack according to claim 10, wherein at least one of said rods is embedded in a fabric sleeve.

13. The rack according to claim 8, further including at least one compartmentalized stowage insert received in said opening.

14. The rack according to claim 13, wherein said compartmentalized stowage insert includes at least one horizontal subdividing shelf.

15. The rack according to claim 13, wherein said compartmentalized stowage insert includes a flexible shell having a pair of side walls, an upper wall, a lower wall and a rear wall.

16. The rack according to claim 15, wherein said flexible shell of said compartmentalized stowage insert is supported in a deployed position by a plurality of support rods.

17. The rack according to claim 16, wherein said plurality of support rods include a plurality of internal struts and a plurality of external rods.

18. The rack according to claim 17, wherein ends of said external rods are inserted in pockets sewn to a surface of said flexible shell of said compartmentalized stowage insert when said insert is deployed.

19. The rack according to claim 18, wherein said internal struts are received in internal sleeves attached to an internal surface of said flexible shell of said compartmentalized stowage insert.

* * * * *